US005127188A

United States Patent [19]

Shaw et al.

[11] Patent Number: 5,127,188

[45] Date of Patent: Jul. 7, 1992

[54] PLANTER BOX BRACKET

[75] Inventors: Donald Shaw, Toronto; Carman Buonito, Markham, both of Canada

[73] Assignee: Integrated Plastics Limited, Againcourt, Canada

[21] Appl. No.: 553,830

[22] Filed: Jul. 18, 1990

[51] Int. Cl.[5] ..... A01G 9/02

[52] U.S. Cl. ..... 47/68; 248/215

[58] Field of Search ..... 248/214, 215, 228, 229, 248/311.2; 47/40, 68

[56] References Cited

U.S. PATENT DOCUMENTS

| | | | |
|---|---|---|---|
| 328,926 | 10/1885 | Elliott | 47/40 |
| 373,472 | 11/1887 | Moser | 248/214 |
| 390,302 | 10/1888 | Koehler | 248/214 |
| 1,374,004 | 4/1921 | Ennis | 248/214 |
| 2,988,314 | 6/1961 | Urich | 248/214 |
| 3,027,014 | 3/1962 | Lindblom | 248/214 |
| 4,949,924 | 8/1990 | Carmody | 248/215 |

FOREIGN PATENT DOCUMENTS

| | | | |
|---|---|---|---|
| 2264722 | 9/1974 | Fed. Rep. of Germany | 47/68 |
| 2600242 | 12/1987 | France | 41/40 |
| 370209 | 8/1963 | Switzerland | 248/228 |

*Primary Examiner*—Henry E. Raduazo

*Attorney, Agent, or Firm*—McFadden, Fincham, Marcus & Anissimoff

[57] ABSTRACT

A bracket for use with a planter box mountable on a partition, window sill or the like. The bracket includes pivotable and vertically adjustable retaining members to retain a planter box and engaging means for mounting the bracket and planter box.

8 Claims, 2 Drawing Sheets

PLANTER BOX BRACKET

BACKGROUND OF THE INVENTION

1. Field of the Invention

This invention relates to a bracket for use with a planter box to mount same on a partition or other such mounting.

2. Description of the Prior Art

Planter box brackets are known in the art. One reference includes U.S. Pat. No. 4,559,738, in which a variety of embodiments of such devices are disclosed. The document discloses various brackets for use with a planter box adapted to sit atop a partition or to be suspended therefrom. Further embodiments include modified boxes with grooves cut therein for positioning of the box about the top of a partition or hooking arms inherent with the box for suspension on a partition. Further still, embodiments are disclosed having a twin box design, twin container and locking box and bracket arrangements. Although a variety of options exist with these arrangements, their set up is difficult and time consuming, since some require tools for their assembly.

Further, in U.S. Pat. No. 4,048,754, a quick assembly planter box and bracket are disclosed having a combined bracket and box for hanging outside a window sill. The disadvantage of this patent over the present invention is that 3 754 requires assembly and it is limited to wooden sill mountings, since eye screws are employed in the suspension of the box. The '754 invention, as in some embodiments of '738, requires that the bracket or bracket and planter box be permanently situated in a mounting. In the case of the removable components, extensive disassembly is required. Therefore, there exists a need for a planter box bracket which requires no assembly and which can accommodate a variety of differently sized planter boxes.

BRIEF SUMMARY OF THE INVENTION

In a broad aspect of the present invention, there is provided a planter box having a mounting bracket wherein the planter box includes opposed sides and end walls and a peripheral top edge surrounding an open top, the improvement comprising: a bracket member for holding the planter box, the bracket member including a longitudinal body, the body having opposed ends and sides, the body having at least two gripping means adapted to slidably retain retaining members, the gripping means being spaced inwardly from the ends of the body, the bracket member further comprising at least a pair of retaining members adapted to retain the planter box, the retaining members being vertically adjustable within the gripping means relative to the body and pivotally movable within the gripping means, the retaining members each having a U-shaped area to receive the planter box and a further engaging means to engage and retain the bracket and the planter box on a mounting.

The device of the present invention thus provides a planter box bracket which does not require assembly, and which includes a spacer for spacing the bracket and box from a mounting surface.

The planter box bracket of the present invention includes a longitudinal body with associated gripping means to releasably and adjustably retain rigid planter box supports. The bracket is mounted on a mounting and the planter box placed thereon. Although the body is disclosed as being a one-piece integral plastic unit, other materials such as sheet metal may function adequately, if the metal material used to make the body and supports includes a non-oxidizing coating, since the bracket is useful for both indoor and outdoor applications. Such suitable metals include stainless steel, copper, bronze, aluminum or brass. If synthetic resins or plastics are used, preferably those resins including rayon, dacron, nylon, formica, fiberglass, polyester, and in the case of plastics, ABS, polystyrene, PVC and plexiglass, could be used to make the bracket. If wood is used, the wood should be treated to prevent water damage. In an alternative embodiment, the longitudinal body and associated gripping means comprise a rigid, preferably cylindrical body having eyelets at each end. The support members could then be inserted within the eyelets to achieve adjustability.

BRIEF DESCRIPTION OF THE DRAWINGS

The invention will be readily understood by the following description of an embodiment of the invention by way of example, in conjunction with the accompanying drawings, in which.

DETAILED DESCRIPTION OF THE PREFERRED EMBODIMENT OF THE INVENTION

Figure 1:
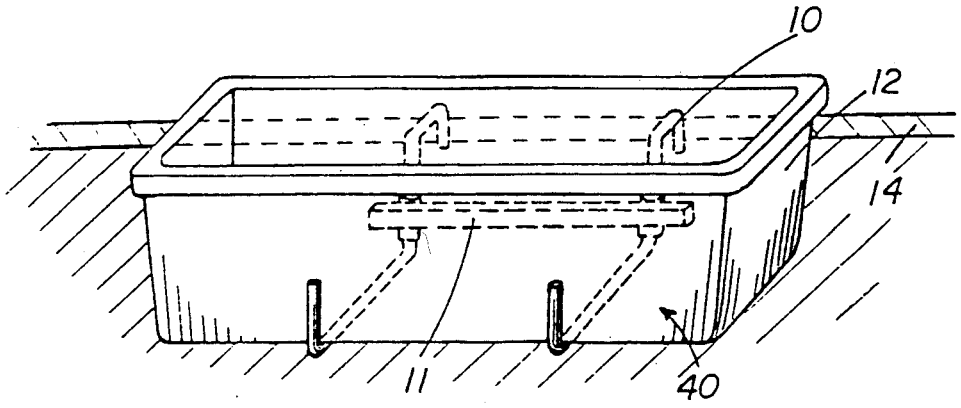
FIG. 1 shows a perspective view of the planter box bracket retaining a planter box as positioned on a mounting.
Figure 2:
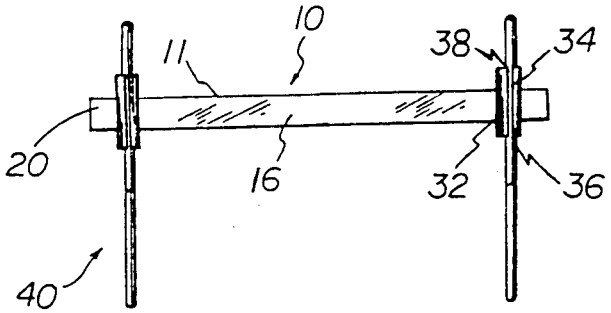
FIG. 2 shows a front view of the planter box bracket.
Figure 3:
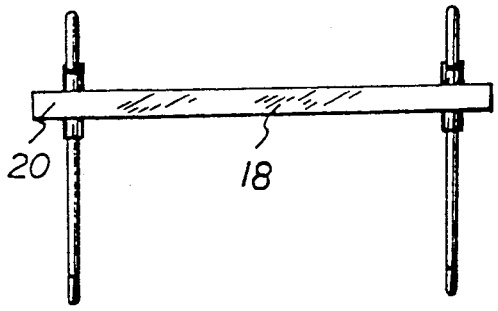
FIG. 3 shows a back view of the planter box bracket.
Figure 4:
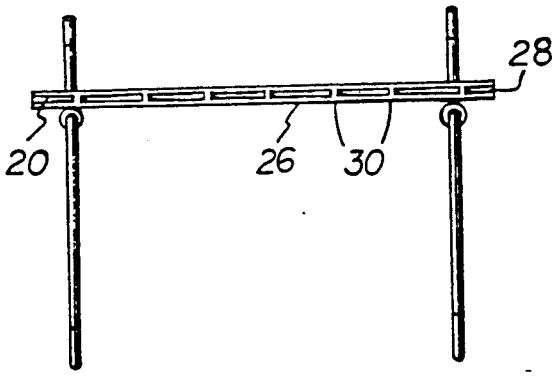
FIG. 4 shows a bottom view of the planter box bracket.

As illustrated in FIG. 1, a perspective view of the planter box bracket 10 and box 12 positioned therein, is shown. The dashed lines indicate a mounting 14 into which the bracket 10 is placed. The bracket 10 can be more clearly seen in FIGS. 2 through 7.

Referring to FIGS. 2 through 5, shown in the Figures in a front, back, bottom and top view of the bracket generally indicated at numeral 10. The longitudinal body 11 of the bracket 10 is preferably constructed of an extruded polymeric substance. The body includes opposed sides 16 and 18, opposed ends 20 and 22, a top 24 and a bottom 26. The bottom 26 of the body 11, as shown more clearly in FIG. 3, preferably includes an open-ended, U-shaped channel 28 transversely extending the length of the body 11 with sequentially spaced supports 30 therein.

Figure 5:
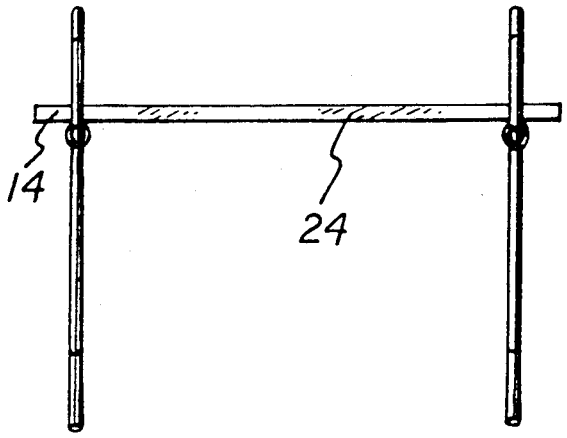
FIG. 5 shows a top view of the planter box bracket.

The channel 28 allows less material to be used in the manufacturing process, while supports provide sufficient strength for the body 11. This structure allows for light weight with adequate strength. On the front side 16 of the bracket 10, there are preferably two hollow housings 32 spaced from the ends 20 and 22 of the body 11. The housings 32 are parallel to the side 16, and preferably associated with the body 11. The housings 32 are preferably cylindrically shaped with an open side 34 and open ends 36 and 38. The housings 32 are greater in length than the width of the sides 16 and 18 of the body 11. This length allows the housings to have sufficient gripping strength in order to prevent inadvertent release of the planter box retaining members 40, as shown in FIGS. 5 and 6.

Figure 6:
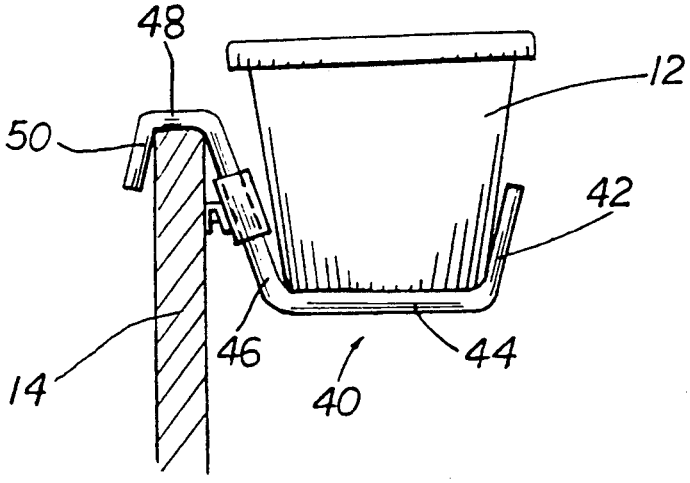
FIG. 6 shows an end view of the planter box bracket positioned such that the bracket is spaced from the mounting.
Figure 7:
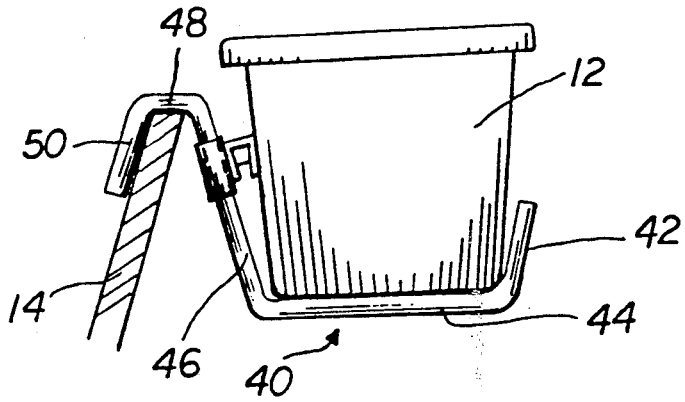
FIG. 7 shows an end view similar to that of FIG. 6, wherein the planter box is spaced from the bracket.

Referring to FIGS. 6 and 7, shown are side views of the retaining members as mounted on a mounting and having a planter box 12 therein. The retaining members 40 are preferably constructed of a unitary rigid material capable of withstanding weight for prolonged periods of time. A first upwardly inclined segment 42 followed by a planar portion 44, and a further upwardly inclined segment 46, collectively define a U-shaped area adapted to accommodate a planter box 12. In order to mount the box 12 and the bracket 10, the retaining members 40 each further include a second planar portion 48 and a downwardly inclined segment 50, which define an engaging space therebetween. The space is adapted to accommodate a mounting 14, such as a walled partition or window sill. The bracket 10 does not require the use of tools or a great length of time to assemble, and can be moved to other locations simply.

Additionally, the bracket has two mounting positions. In a first position, as illustrated in FIG. 6, the retaining members 40 are pivoted within the housings 32 so that the body 11 projects outwardly. In this arrangement, the bracket 10 can be spaced from a mounting 14. Once the bracket 10 and planter box 12 are in position, the body 11 may be vertically slid upwardly or downwardly to space the bracket from a mounting and to adjust the mounting to bracket angle.

In a second position, shown in FIG. 7, the body 11 may project inwardly. This position is achieved by pivoting the retaining member 40 within the housing 32, enabling the body 11 to project inwardly. The inward projection of body 11 permits adjustment of the planter box to retaining member angle. Additionally, this arrangement allows differently sized planter boxes to be used with the same bracket. The bracket 10 having pivoting retaining members is completely collapsible for storage while not in use, or the entire bracket may be disassembled by removing the retaining members 40 from the housings 32.

The bracket of this invention provides a novel planter box bracket which is easily installed and which does not require extensive assembly, unlike arrangements in the known art.

It is to be understood that the specific embodiment of the invention herein disclosed and described is presented for the purpose of explanation and illustration, and is not intended to indicate limits of the invention, the scope of which is defined in the claims.

We claim:

1. In a planter box having a mounting bracket wherein the planter box includes opposed sides and end walls and a peripheral top edge surrounding an open top, the improvement comprising:

a bracket member for holding said planter box, said bracket member including a longitudinal body, said body having opposed ends and sides, said body having at least two gripping means adapted to slidably retain retaining members, said gripping means being spaced inwardly from said ends of said body, said bracket member further comprising at least a pair of retaining members adapted to retain said planter box, said retaining members being vertically adjustable within said gripping means relative to said body and pivotally movable within said gripping means, said retaining members each having a U-shaped area to receive the planter box and a further engaging means to engage and retain said bracket and said planter box on a mounting.

2. A bracket as defined in claim 1, wherein said retaining members comprise rigid material.

3. A bracket as defined in claim 1, wherein said gripping means each comprise a hollow housing, said housing adapted to releasably retain said retaining member.

4. A bracket as defined in claim 1, wherein said body member comprises an elongated rectangular polymeric material, said rectangular body having a top, a bottom, opposed sides and ends, said bottom and ends being open, defining a transversely extending U-shaped channel therein, said channel having sequentially spaced supports therein parallel to said ends.

5. A bracket as defined in claim 1, wherein said retaining members are removable from said gripping means.

6. A bracket as defined in claim 4, wherein said body member is a spacer whereby said body spaces said planter box from said mounting.

7. The bracket as defined in claim 6, wherein said retaining members are spaced from said mounting.

8. The bracket as defined in claim 1, wherein said bracket is collapsible.

* * * * *